US005941245A

United States Patent [19]

Hannah et al.

[11] Patent Number: 5,941,245

[45] Date of Patent: Aug. 24, 1999

[54] CREW OXYGEN MASK WITH IMPROVED COMFORT CONTROL APPARATUS

[75] Inventors: Gary Hannah, Merriam, Kans.; Michael D. Ford, Independence, Mo.

[73] Assignee: Nellcor Puritan Bennett, Pleasanton, Calif.

[21] Appl. No.: 08/954,459

[22] Filed: Oct. 20, 1997

[51] Int. Cl.[6] ..... A62B 18/08

[52] U.S. Cl. ..... 128/207.11; 128/206.21; 128/206.27; 128/202.27; 128/201.22

[58] Field of Search ..... 128/207.11, 202.27, 128/206.27, 205.25, 201.19, 206.12, 206.21, 201.22, 201.24; 2/6.1, 413, 454, 68, 421; 24/331

[56] References Cited

U.S. PATENT DOCUMENTS

| | | | |
|---|---|---|---|
| 2,287,939 | 6/1942 | Kraft . | |
| 2,449,548 | 9/1948 | Burns . | |
| 3,040,741 | 6/1962 | Carolan | 128/207.11 |
| 3,056,402 | 10/1962 | Dickinson | 128/207.11 |
| 3,347,566 | 10/1967 | Nelson | 128/202.27 |
| 3,599,636 | 8/1971 | Gutman et al. . | |
| 3,672,384 | 6/1972 | Hellguist . | |
| 3,792,702 | 2/1974 | Delest | 128/207.11 |
| 3,850,168 | 11/1974 | Ferguson et al. | 128/207.11 |
| 4,437,462 | 3/1984 | Piljay et al. | 128/207.11 |
| 4,664,108 | 5/1987 | Ansite | 128/202.26 |
| 4,915,106 | 4/1990 | Aulgur et al. | 128/207.11 |
| 5,036,846 | 8/1991 | Aulgur et al. | 128/207.11 |
| 5,503,147 | 4/1996 | Bertheau | 128/207.11 |
| 5,623,923 | 4/1997 | Bertheau et al. | 128/201.22 |
| 5,664,566 | 9/1997 | McDonald et al. | 128/207.11 |

FOREIGN PATENT DOCUMENTS

| | | | |
|---|---|---|---|
| 288391 | 10/1988 | European Pat. Off. . | |
| 2516391 | 5/1983 | France . | |
| 861574 | 2/1961 | United Kingdom | 128/207.11 |

*Primary Examiner*—John G. Weiss
*Assistant Examiner*—V. Srivastava
*Attorney, Agent, or Firm*—Hovey, Williams, Timmons & Collins

[57] ABSTRACT

Inflatable harness respiratory apparatus (10) is provided having an improved comfort control assembly (16) allowing reduction in the engagement force exerted by the fitting surface (20) of the mask (12) against the face of the user. The mask (12) is equipped with an inflatable harness strap element (26) having terminal ends (28, 30) supported on stationary, tubular mask mounts (36) via housing assemblies (38). In one embodiment, the terminal ends (28, 30) are releasably locked onto the mounts (36) by means of locks (52), but are axially shiftable along the length of the mounts (36) in order to adjust the effective distance between the fitting surface (20) and the terminal ends (28, 30). An adjustment button (78) may be depressed in order to disengage the locks (52) and permit shifting of the associated terminal end (28, 30). Alternately, an intermediate comfort position is pneumatically achieved by controlled pressurization of an internal cavity (128) within the housing assembly (88).

11 Claims, 2 Drawing Sheets

CREW OXYGEN MASK WITH IMPROVED COMFORT CONTROL APPARATUS

BACKGROUND OF THE INVENTION

1. Field of the Invention

The present invention is broadly concerned with respiratory apparatus of the type commonly used by commercial or private aircraft crew during emergency situations. More particularly, the invention pertains to such respiratory apparatus having a full or partial face mask with an extensible and inflatable strap element coupled to the mask which is initially inflated and expanded to allow ready donning of the respiratory device followed by deflation of the strap element to draw the mask into tight engagement with the user's head; the respiratory apparatus of the invention includes a comfort control assembly permitting controlled lessening of the engagement force exerted by the mask against the user's face so that the apparatus may be worn for an extended period of time without discomfort.

2. Description of the Prior Art

An inflatable head harness for respirator devices is described and illustrated in U.S. Pat. No. 3,599,636 and comprises a mask that is connected to an elongated, extensible harness or strap having internal conduits connected by a valve to a source of pressurized air. When the valve is opened, air admitted to the conduits of the strap cause the strap to stretch and assume a somewhat rigid configuration. In this manner, the user can grasp the mask with one hand and direct the inflated strap behind his or her head, a particularly useful feature in an emergency situation for a flight crew when only one free hand is available.

Once the harness of the respirator shown in U.S. Pat. No. 3,599,636 is placed over the head, the strap is deflated and contracts in length. Thereafter, the inherent resiliency of the deflated strap urges the mask in tight engagement with the nose and mouth areas of the wearer's face in an attempt to avoid peripheral leakage of the breathable gas.

As a rule, flight crew masks must be pressurized when the aircraft is flying at cabin altitudes above approximately 40,000 feet in order to force air into the user's lungs. At these altitudes, therefore, the straps must exert a relatively large biasing force pressing the mask against the face to overcome the pressure of the oxygen urging the mask away from the skin and prevent oxygen leakage around the peripheral seal of the mask. However, at cabin altitudes of less then 40,000 feet, pressurized breathing conditions within the chamber of the mask are unnecessary and the regulator operates upon demand breathing such that an oxygen enriched air mixture is admitted to the mask only as the user inhales.

In general, the substantial majority of flight time is incurred at cabin altitudes at less then 40,000 feet. There are many situations, however, where the respiratory mask must be worn at all times such as cases where only one crew member is present. Therefore, the harness straps represent a substantial source of discomfort at lower altitudes when the respirator must be worn on the head at all times since the straps normally present a large degree of force even though pressurized breathing conditions are unnecessary.

U.S. Pat. No. 5,036,846 describes an inflatable harness crew oxygen mask provided with a pneumatic comfort adjustment. In the '846 patent, inflation control means is provided having structure for selective establishing and maintaining the inflatable strap element at an intermediate pressure therein between the high-pressure extended position of the strap element and low-pressure retracted position thereof. Similarly, U.S. Pat. Nos. 5,623,923 and 5,503,147 describe inflatable strap comfort control devices which selectively inflate or deflate the strap element during use so as to achieve user comfort.

A problem with these prior comfort adjustment devices stems from the pneumatic character thereof i.e., they rely upon controlling pressure conditions within the strap element. However, this can be a problem if the strap element experiences significant leakage, in as much as the comfort control feature can then be rendered inoperative.

There is accordingly a need in the art an improved comfort control assembly forming a part of an inflatable harness respiratory device which permits comfort control without the need for controlled partial inflation or deflation of the strap element during wearing of the respiratory device. Preferably, such an improved comfort assembly would permit the desired degree of comfort control adjustment while the strap element remains fully deflated and essentially at ambient pressure.

SUMMARY OF THE INVENTION

The present invention overcomes the problems outlined above, and provides an improved comfort adjustment for inflatable harness respiratory apparatus. Broadly speaking, the respiratory apparatus of the invention includes a mask presenting a fitting surface adapted to fit against the face of a user and has means for delivery of pressurized breathable gas into the mask. The mask is further equipped with an extensible, selectively inflatable and deflatable strap element presenting a pair of terminal ends operatively coupled with the mask. The strap element is designed so that when inflated it assumes an enlarged configuration for ready donning over the head of the user; when the strap element is deflated it constricts and comes into engagement with the user's head, thereby drawing the mask into tight fitting engagement with the user's face. The comfort adjustment allows lessening of the engagement force exerted by the mask against the user's face. This comfort adjustment comprises a mounting member on the mask operatively supporting at least one of the strap element terminal ends and allowing translational shifting movement between the one strap element terminal end and the mask fitting surface. Further, a stop is provided for locking the one terminal end on the mounting member at a selected position relative to the mask fitting surface. As indicated, in preferred forms, such relative translational shifting movement occurs when the strap element is fully deflated.

Preferably, the strap element is mounted with both terminal ends thereof adjustably supported on corresponding mounting members. In this way one or both sides of the strap element can be adjusted.

The mounting members are advantageously stationary and in the form of elongated tubular bodies which are oriented coaxially within corresponding housing assemblies secured to the terminal ends of the inflatable strap. In this form, the terminal ends are axially adjustable along the length of the mounts so as to vary the distance between the strap terminal ends and the fitting surface of the mask. In addition, the stationary tubular mounts are coupled with a mask regulator so that the mounts serve as a means of inflating and deflating the strap element. Each housing assembly includes an elongated tubular housing secured to a corresponding strap element terminal end. A pair of annular, opposed, front and rear seals are located within the housing and cooperatively defined therein a cavity; one of the seals is movable with the housing while the other seal is secured to the tubular mount. An aperture is provided through the wall of the tubular mount between the front and rear seals. Upon inflation of the strap element, the housing and strap element terminal end are shifted along the length of the tubular mount to a normal or initial position, and the cavity is pressurized along with the strap element. When the strap element is deflated to essentially ambient internal pressure, the pressurized gas within the cavity is also exhausted. Thereupon, the housing assembly and attached terminal end of the strap element can be manually adjusted along the length of the tubular support. This effectively increases the internal size of the strap element and reduces the engagement force exerted by the mask fitting surface against the user's face.

In another embodiment a similar comfort adjustment is provided which serves to position the mask fitting surface relative to the strap element terminal ends at a preset intermediate position. In this adjustment structure, the housing is equipped with a relief orifice which is normally closed by means of a spring-loaded seal. When the strap element is inflated the internal housing cavity is pressurized until the spring-loaded seal is overcome and pressurized gas from the cavity begins to escape to the atmosphere. Upon deflation of the strap element the housing cavity remains in a pressurized condition.

DETAILED DESCRIPTION OF THE PREFERRED EMBODIMENT

Figure 1:
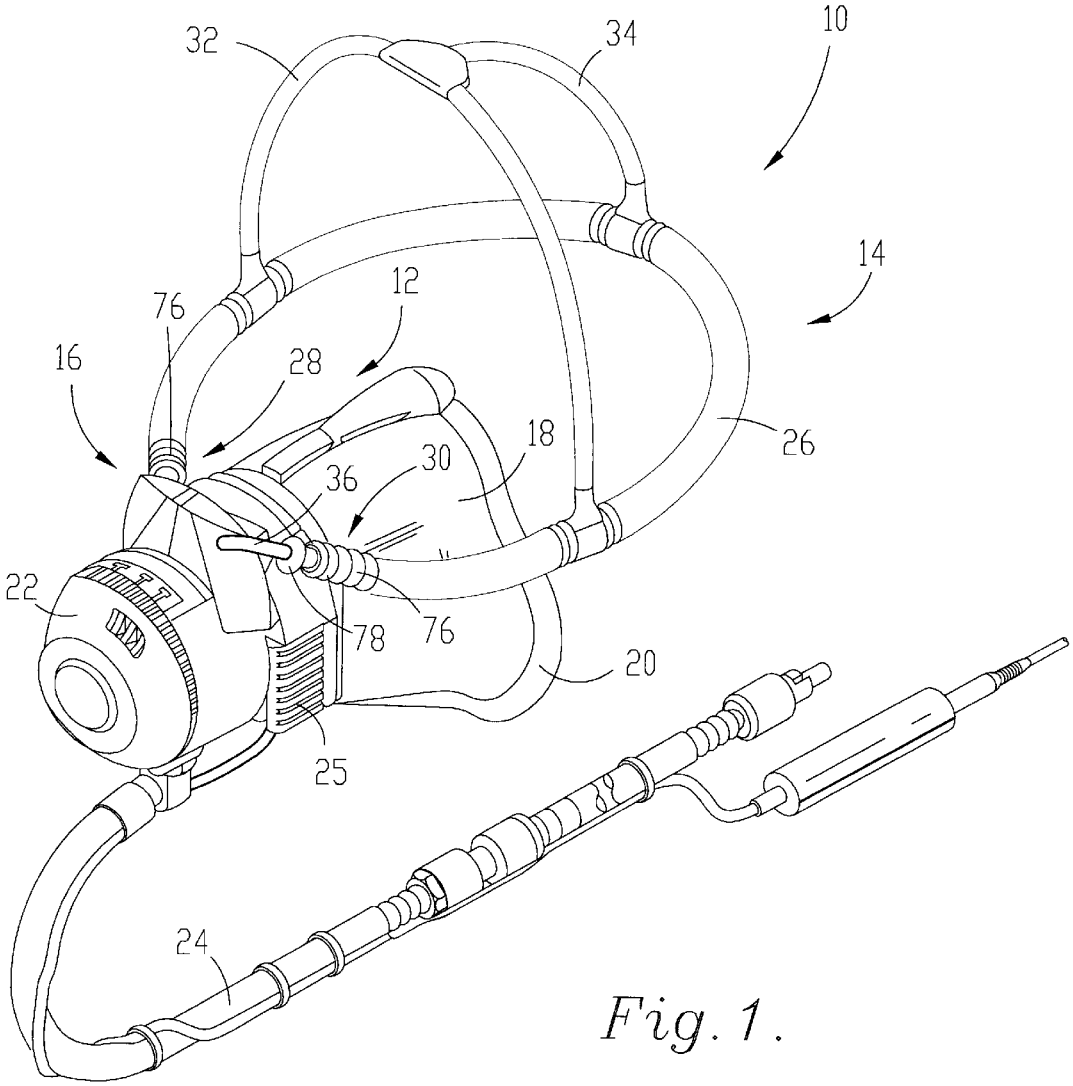
FIG. 1 is a perspective view of a preferred respiratory apparatus in accordance with the invention.

Turning now to the drawings and particularly FIG. 1, respiratory apparatus 10 in accordance with the invention is illustrated. Broadly speaking the apparatus 10 includes a mask 12 equipped with an inflatable-type harness assembly 14 and a comfort adjustment assembly 16 which allows lessening of the engagement force exerted by the mask against a user's face.

In more detail, the mask 12 includes a synthetic resin main body 18 presenting a marginal resilient lip defining a fitting surface 20 adapted to engage a user's face in surrounding relationship to the user's nose and mouth. The mask 12 is also equipped with a regulator 22 which is designed to mix incoming pressurized breathable gas (usually oxygen) with atmospheric air for delivery of a breathable gas mixture into the confines of the mask body 18; the regulator is of the type described in U.S. Pat. No. 5,307,793 which is incorporated by reference herein. A gas line 24 is operatively coupled to the regulator 22 as shown with the remote end thereof adapted for coupling to a conventional gas source. A harness inflation button 25 is also provided as a part of the regulator 22.

The harness assembly 14 includes an elongated, inflatable, tubular strap element 26 having a pair of terminal ends 28, 30 operatively coupled to mask 12 as will be described. A somewhat U-shaped strap 32 is connected to opposite sides of the element 26 as shown, and is configured to extend over a wearer's head. A secondary strap 34 extends from the top of strap 32 and is secured to strap element 26 at a rear portion thereof. The strap element 26 is formed of extensible synthetic resin material and is selectively inflatable so as to extend and assume an enlarged configuration allowing ready fitting of the harness assembly over the user's head. Upon deflation of the strap element 26, the latter constricts and comes into tight engagement with the user's head, thereby serving to draw the mask 12, and particularly fitting surface 20 thereof, into tight engagement with the user's face. Strap elements of this type are known, see, e.g., U.S. Pat. No. 4,915,106 which is incorporated by reference herein.

Figures 2, 3, 4, 5:
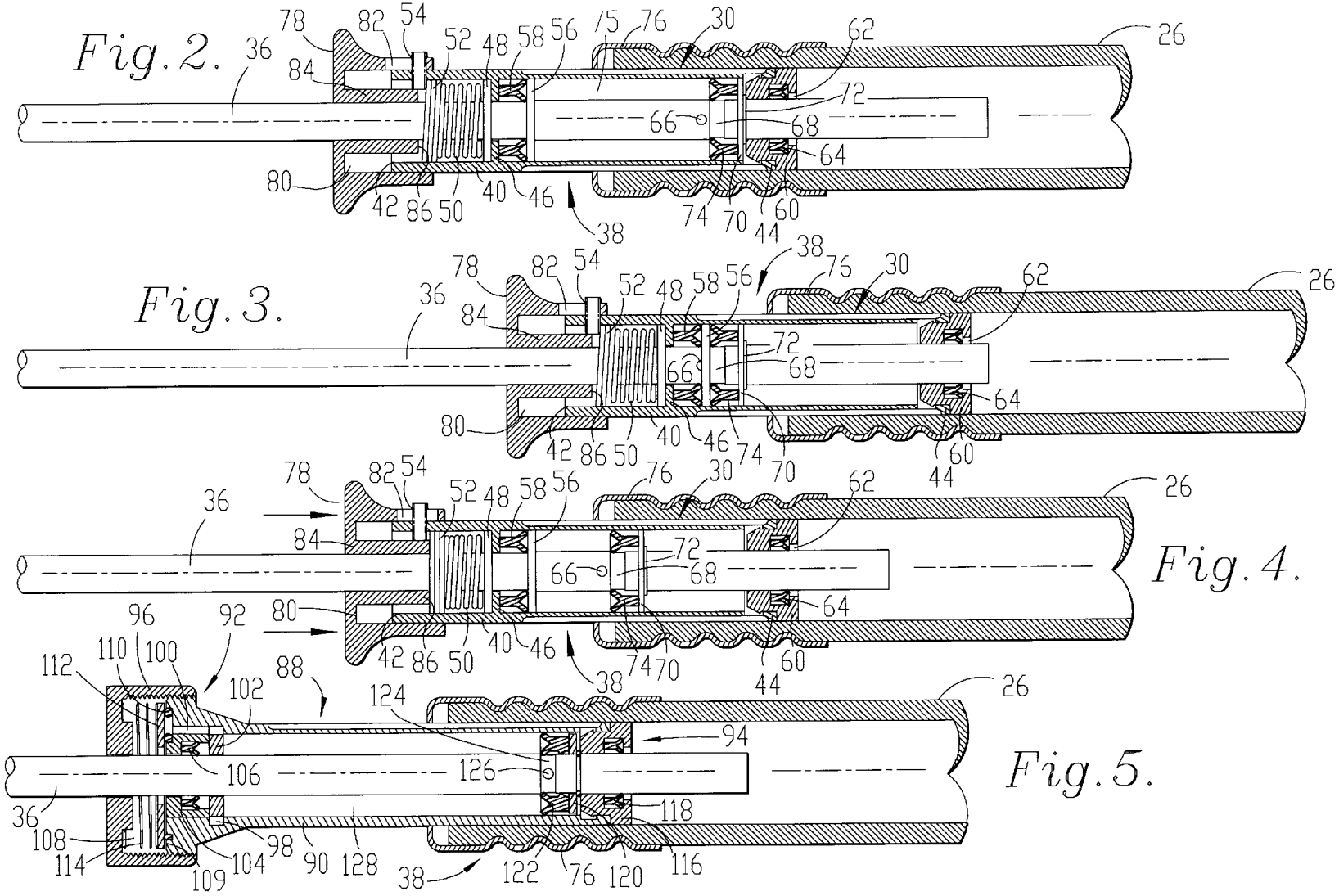
FIG. 2 is an enlarged, fragmentary cross-sectional view illustrating the construction and mounting of the terminal ends of the inflatable harness strap element to the mask of the respiratory apparatus of FIG. 1, with the mounting structure shown in its normal position.
FIG. 3 is a view similar to that of FIG. 1, but illustrating the mounting structure in its most extended position.
FIG. 4 is a view similar to that of FIG. 2, but illustrating the adjustment sequence wherein the terminal end of the inflatable harness strap element is adjusted relative to the fitting surface of the mask.
FIG. 5 is an enlarged, fragmentary cross-sectional view illustrating another embodiment of the invention and depicting the construction and mounting of the terminal ends of the inflatable harness strap.

The comfort adjustment assembly 16 includes a pair of elongated, tubular metallic (aluminum) mounts 36 which extend from regulator 22 as shown, as well as a housing assembly 38 (see FIGS. 2–4) supported at each terminal end 28, 30 of the strap element 26. Referring specifically to FIGS. 2–4, it will be observed that each assembly 38 includes an elongated, tubular metallic housing 40 presenting opposed, front and rear ends 42 and 44, as well as an inwardly extending integral annular stop wall 46. As shown, a corresponding tubular mount 36 extends coaxially throughout the length of housing 40 and into the confines of strap element 26. The forward end of housing 40 includes an annular Delrin washer or bushing 48 which abuts the forward face of stop wall 46. A coil spring 50 engages the face of bushing 48 remote from stop wall 46. Three separate, annular brake or stop washers 52 engage the forward end of spring 50. As is evident from the drawings, the bushing 48, spring 50 and stop washers 52 each slidably receive the tubular mount 36. However, the stop washers 52 have relatively large central openings therethrough permitting the washers to rock to a limited degree on the mount 36 and assume a canted, locking position relative thereto. A pin 54 is mounted through the sidewall of housing 40 adjacent end 42 and engages the adjacent face of the forward most stop washer 52, thus captively retaining, with the mount 36, the stop washers 52, spring 50 and bushing 48 between the pin wall 46.

The mid-portion of housing 40 is provided with a fixed Delrin bushing 56 spaced rearwardly from stop wall 46. A resilient annular forward seal 58 is located between the wall 46 and bushing 56 as shown. The rearward end of housing 40 has a Delrin rear seal 60 secured to the housing body. The seal 60 has an enlarged, irregular annular relieved zone 62 at the rearward end thereof which houses a supplemental resilient annular seal 64.

Referring specifically to the mount 36, it will be observed that it includes an aperture 66 through the sidewall thereof and moreover has an adjacent relieved area 68 formed in the outer sidewall thereof. The mount 36 carries a fixed Delrin bushing 70 rearwardly of the aperture 66 and relieved area 68, with the bushing 70 being secured via a coupler 72. An annular resilient rear seal 74 is situated in engagement with the forward face of bushing 70, with the front edge of the seal 74 engaging the forward shoulder of the relieved area 68. Thus, the bushing 70 and seal 74 are secured to the mount 36 and move in unison therewith. As best observed in FIG. 2, a cavity 75 is defined between the seals 58 and 74.

The terminal ends 28, 30 of the strap element 26 are affixed to the corresponding housings 40 by means of a crimp ferrule 76 or other expedient. Thus, the housing 40 and components coupled thereto are effectively secured to the strap element 26.

An annular adjustment button 78 is slidably secured to the forward end 42 of housing 40. Specifically, the button 78 includes an annular recess 80 receiving the end 42. The sidewall of the button has a slot 82 therein which accommodates pin 54, thus defining the movement stroke of the button. The inner annular wall 84 of the button slidably receives the mount 36 and presents an annular butt end 86.

The use of the embodiment of FIGS. 1–4 proceeds as follows, assuming that the mask is stored in a ready position, usually in a stowage box adjacent the crew seating. As stowed, the respective terminal ends 28, 30 of the strap element 26 are slidably mounted on the corresponding mounts 36, and are releasably locked in place via the stop washers 52. The user first grasps the mask and pulls it from its stowage box while depressing the button 25. This causes pressurized oxygen to flow through the regulator and thence through the mounts 36 so as to fully inflate harness 26 so that the latter assumes an enlarged position permitting ready donning over the head of the user (see FIGS. 2–4). At the same time, however, pressurized oxygen flows through aperture 66 so as to pressurize the cavity 75. This induces movement of housing 40 the left as viewed in FIG. 4, and the frictional engagement between the tube 36 and stop washer 52 moves the latter to their upright release position thereby allowing free movement of the housing. In this condition, the assembly 38 assumes the normal position depicted in FIG. 2.

Once the mask is donned with the strap element 26 in its inflated condition, the user releases the button 25. This causes an immediate deflation of the strap element 26, with the oxygen therein flowing back through the tubular mount 36 for exhaustion to the atmosphere through regulator 22. During this sequence, the pressurized oxygen within chamber 75 is also exhausted via aperture 66. Thus, the strap element 26 and the cavity 75 are at essentially ambient pressure, with the seals 58 and 74 spaced apart as shown in FIG. 2 and with the strap element 26 shifted relative to the mount 36 so that the latter extends well into the confines of the strap element.

It will be appreciated that in the initially deflated condition, the strap element may fit extremely tightly against the head of the user, to the extent that it may be uncomfortable. In order to afford a more comfortable wearing, the user may then optionally depress the button 78 as best seen in FIG. 4. When this is done, the butt end 86 of wall 84 comes into contact with the canted stop washers 52, to move these to a more orthogonal position relative to the mount 36 out of frictional locking engagement with the mount. Further depression of the button 78 serves to compress spring 50 and translates housing 40 and the terminal end 30 of the strap element 26 along the length of the tubular mount 36. This effectively increases the harness size, i.e., the relative distance between the terminal end 30 and fitting surface is changed so as to lessen the engagement force exerted by the fitting surface 20 of mask 12 against the user's face. It will be appreciated that once the button 78 is released, the spring 50 serves to shift the button back to its starting position and causes the stop washers 52 to reassume their canted, locking position. As a consequence, the effective size of the strap element 26 can be increased to any desired extent within a preset range, thus permitting essentially infinite adjustment of the mask engagement force against the user's face.

It will of course be appreciated that either one or both of the terminal ends 28, 30 of the strap element 26 may be adjusted along the length of the corresponding mounts 36. This effectively doubles the range of adjustment afforded by the apparatus 10. Generally, each terminal end of strap element 26 is translatable along a corresponding mount 36 through a distance of at least about ½ inch, more preferably at least about ¾ inch.

FIG. 3 illustrates the adjustment assembly 16 at its most extended position, where it will be observed that the aperture 66 is between the seals 58 and 74. Thus, upon inflation of the strap element 26 through the medium of regulator 22, the seal 58 and associated structure is shifted leftwardly as seen in FIG. 3 until the assembly 38 assumes the normal FIG. 2 position. Thus, no matter what the relative position of the strap assemblies 38 may be on the corresponding mounts 36, upon inflation of the strap element 26, the assemblies 38 each reset to the same, normal position shown in FIG. 2.

FIG. 5 illustrates an alternative embodiment in accordance with the invention making use of a modified housing assembly 88 for each terminal end of the strap element 26. As in the case of the embodiment of FIGS. 1–4, each assembly 88 includes a tubular housing 90 which is secured to a terminal end 38 of the strap 26, being affixed by ferrule 76. The housing 90 includes a forward end 92 and an opposed rearward end 94. The forward end 92 is externally threaded, and an annular cap 96 is mounted between.

The forward end 92 is configured to present an annular relief passageway 98 which communicates with an axial relief passageway 100. An annular metallic bushing 102 is supported adjacent passageway 98 and abuts an annular, cup-shaped seal retainer 104. A small clearance is provided between the rearward face of bushing 102 and passageway 98. A resilient annular seal 106 is seated within retainer 104, and engages mount 36. The passageway 100 communicates with a cavity or zone 108 between cap 96 and the forward butt end 109 of housing 90. An O ring 110 is seated against the butt end 109 in surrounding relationship to the passageway 100. An annular bushing 112 engages O-ring 110 and butt end 109 as illustrated. A spring 114 is situated within zone 108 between cap 96 and bushing 112. The engagement force of spring 114 against bushing 112 serves to compress O ring 110 and form a seal, normally preventing escape of gas through passageway 100. An oxygen escape opening (not shown) is provided through a wall of cap 96 in communication with zone 108.

The rearward end of housing 90 is equipped with a seal 116 similar to the seal 62 described previously; the seal 116 carries an annular resilient inner sealing ring 118 as shown which engages mount 36. A bushing unit 120 is affixed to element 36 and supports a resilient annular near seal 122. The latter is maintained in place by engagement with the forward shoulder of relieved area 124 provided on the mount 36. An aperture 126 is provided through the wall of mount 36 at area 124. A cavity 128 is thus formed between the seal 122 and the forward end 92 of housing 90.

The use of the FIG. 5 embodiment proceeds in its initial stages exactly as described with reference to the first embodiment. That is, the user grasps the mask body and depresses button 25 thereby causing pressurized oxygen to flow through the mount 36 for expansion of strap element 26. At the same time, such pressurized oxygen is delivered via aperture 126 so as to pressurize cavity 128. This moves housing 90 and the terminal end 38 of strap element 26 leftwardly as shown in FIG. 5 until the pressure within cavity 128 exceeds a predetermined maximum set by the engagement force of spring 114 against bushing 112 and O ring 110. When this maximum pressure is exceeded, oxygen begins to escape through passageway 100 and to the atmosphere via the cap escape opening. This in turn prevents further movement of the housing 90 and terminal end 38 relative to the mount 36. Upon deflation of the strap element 26, the cavity 128 remains pressurized.

During use of the respiration assembly of FIG. 5, the cavity 128 remains pressurized and maintains the comfort position for the mask. It will be appreciated that once the spring engagement force for the assembly 88 is set, the FIG. 5 embodiment is not further adjustable.

It will be appreciated that the comfort control apparatus of both of the above embodiments indefinitely maintains a comfortable engagement force between the fitting surface 20 of mask 12 and the user's face, while the strap element 26 is fully deflated. Thus, leakage from strap 26 is not a factor in maintaining comfort control.

When the user wishes to remove the respiratory apparatus 10, the button 25 is again depressed to fully inflate the strap element 26 allowing the apparatus 10 to be easily removed. At this point the strap element 26 is again deflated and is ready for stowage.

We claim:

1. In respiratory apparatus adapted to fit upon the head of a user and comprising a mask presenting a fitting surface adapted to fit against the face of said user, means for delivery of pressurized breathable gas into said mask, and an extensible, selectively inflatable and deflatable strap element presenting a pair of terminal ends operably connected with said mask, said strap element when inflated assuming an enlarged configuration allowing ready donning of the apparatus over the head of the user, said strap element when deflated assuming an initial position and coming into engagement with the user's head and thereby drawing said mask into tight engagement with the user's face, the improvement of a comfort adjustment for the respiratory apparatus allowing lessening of the engagement force exerted by the mask against the user's face, said comfort adjustment comprising:

a mounting member on said mask operatively supporting at least one of said strap element terminal ends and allowing relative translational shifting movement between said one strap element terminal end and said mask fitting surface;

a stop for locking said one strap element terminal end on said mounting member; and an adjuster operable to selectively disengage said stop and permit adjustment of the relative position of said one element terminal end and said mask fitting surface to any of a plurality of positions when said strap element is deflated and assumes said initial position and draws said mask into said tight engagement with the user's face, said stop operable to lock said strap element terminal end on said mounting member at any of said plurality of positions, said mounting member including mechanism operable to cause said strap element to reassume said initial position when the strap element is subjected to an inflation/deflation cycle, irrespective of the position of said strap element terminal end prior to said inflation/deflation cycle.

2. The respiratory apparatus of claim 1, there being a mounting member for each of said strap element terminal ends for supporting each of the strap element terminal ends for relative shifting movement between both strap element terminal ends and said mask fitting surface.

3. The respiratory apparatus of claim 1, said mounting member comprising an elongated, stationary tubular body supported on said mask, at least a portion of said tubular body being oriented coaxially within said strap element, said one strap element terminal end being shiftable relative to and along the length of the mounting member.

4. The respiratory apparatus of claim 3, there being a regulator operably coupled with said mask for said delivery of pressurized breathable gas into said mask, said tubular body being operably coupled with said regulator for passage of said breathable gas through the tubular body for inflation of said strap element.

5. The respiratory apparatus of claim 3, including a housing disposed within and adjacent said one strap element terminal end, said tubular body extending through said housing and into the confines of said strap element, said stop comprising a frictional locking element carried on said tubular body and engageable with said housing.

6. The respiratory apparatus of claim 5, including a pair of annular opposed seals within said housing and disposed about said tubular body, one of said seals being mounted within and movable with said housing, the other of said seals being secured to said tubular body for movement therewith, said seals cooperatively defining a cavity therebetween within said housing, there being an aperture through a wall of said tubular body communicating the interior of the tubular body with said cavity.

7. The respiratory apparatus of claim 6, including a relief orifice in communication with said cavity for establishing a predetermined pressure condition within the cavity upon inflation and subsequent deflation of said strap element.

8. The respiratory apparatus of claim 1, said one strap element terminal end and said mask fitting surface being relatively shiftable while said strap element is maintained at ambient pressure.

9. The respiratory apparatus of claim 1, said one strap element terminal end being axially shiftable along the length of said mounting member through a distance of at least about one-half inch.

10. The respiratory apparatus of claim 1, said adjuster being manually engageable by said user.

11. The respiratory apparatus of claim 10, said stop being spring-loaded and operably coupled with said adjuster to lock said strap element terminal end when said adjuster is released by said user.

* * * * *